United States Patent [19]

Nussbaum

[11] Patent Number: 4,860,642

[45] Date of Patent: Aug. 29, 1989

[54] PERSONALIZED AIR CONDITIONING AND METHOD

[76] Inventor: Otto J. Nussbaum, 144 Penns Woods Dr., Newtown, Pa. 18940

[21] Appl. No.: 291,404

[22] Filed: Dec. 19, 1988

Related U.S. Application Data

[63] Continuation of Ser. No. 905,475, Sep. 8, 1986, abandoned, which is a continuation-in-part of Ser. No. 743,384, Jun. 11, 1985, Pat. No. 4,646,966.

[51] Int. Cl.[4] ..... F24F 7/06

[52] U.S. Cl. ..... 98/40.19; 98/31; 98/346

[58] Field of Search ..... 236/49, 13, 38; 237/49; 98/31, 38.1, 38.6, 38.9, 40.18, 40.19, 42.01, 42.02, 34.6; 165/22, 54

[56] References Cited

U.S. PATENT DOCUMENTS

| | | | |
|---|---|---|---|
| 2,434,847 | 1/1948 | Hagen | 98/38.9 |
| 2,633,070 | 3/1953 | Gillham | 165/54 X |
| 2,877,990 | 3/1959 | Goemann | 165/48.1 |
| 3,927,827 | 12/1975 | Strindehag | 98/40.18 X |
| 4,135,440 | 1/1979 | Schmidt et al. | 98/31 |
| 4,353,411 | 10/1982 | Harter et al. | 98/40.19 X |
| 4,531,454 | 7/1985 | Spoormaker | 98/31.6 |

FOREIGN PATENT DOCUMENTS

| | | | |
|---|---|---|---|
| 2938702 | 4/1981 | Fed. Rep. of Germany | 98/40.19 |

*Primary Examiner*—William E. Tapolcai

*Attorney, Agent, or Firm*—Panitch Schwarze Jacobs & Nadel

[57] ABSTRACT

An air conditioning system in a building space having side walls and a hollow horizontal partition or wall which provides a generally unobstructed chamber or plenum for preconditioned air at or close to atmospheric pressure, a hollow column extending from the horizontal partition at a selected location for receiving conditioned air, air outlets in the column for distributing air to the immediate environs of the column, a fan in the column for moving air from the plenum into the column and through the air outlets, and a selectably variable fan control in the building space.

4 Claims, 6 Drawing Sheets

62
63
56
55
64
64
58
57
60
60
2
2
28
12
61
27
27
27
49
45
46
48
50
44
47
30
34
32
31
40
37
35
39
43
36
38
42
33
70
16
10
41
26
19
15
15
18
25
20
21
22
17

PERSONALIZED AIR CONDITIONING AND METHOD

CROSS REFERENCES TO RELATED APPLICATIONS

This application is a continuation of U.S. application Ser. No. 9,05,475 filed Sept. 8,1986, now abandoned; which is a continuation-in-Part of my co-pending U.S. application Ser. No. 743,384, filed June 11, 1985, now U.S. Pat. No. 4,646,966.

BACKGROUND OF THE INVENTION

In the field of commerical heating and air conditioning, there are known to be problems causing discomfort to the occupants inefficiencies resulting in excessive cost to the building operator, and inconveniences in operation and control of present systems.

For example, central building control of termperature, air flow, humidity, and the like, or even individual room control usually leaves some persons in the building or room uncomfortable or dissatisfied with their work environment. Also, different locations in a building, or even in a single room, are not satisfactorily cooled or heated, giving rise to complaints about discomfort and resulting in loss of productivity.

Further, conventional air conditioning systems generally require expensive duct work, usually in floors or ceilings, or both, and cause unnecessary heating and cooling of much unused space, particularly that above the head level of workers, for example the upper four feet of space in a room having a twelve foot ceiling. Such duct work also imposes a substantial power load for movement of air through the ducts.

Also, in conventional heating and air conditioning systems, it has not been economically feasible to incorporate lighting, plumbing and other utilities.

Prior systems with floor outlet grills limited the location of furniture and equipment; and also created areas of discomfort, as by high air velocity and extreme temperature.

Applicant is aware of the below listed prior art:

| U.S. Pat. No. | Patentee |
|---|---|
| 2,877,990 | GOEMANN |
| 2,971,747 | YOUNG |
| 3,354,946 | DEAN, JR. |
| 3,516,347 | MAY |
| 3,690,370 | PIPER |
| 3,693,705 | STOTZ |
| 3,908,751 | SHEPPARD, JR. |
| 4,135,440 | SCHMIDT ET AL |
| 4,353,411 | HARTER ET AL |
| 4,425,839 | STULL |

| SOUTH AFRICAN PATENT APPLN. NO. | APPLICANT |
|---|---|
| 81/5869 (filed August 25, 1981) | Ventline Manufacturing (PTY) Limited |

The word "plenum" is used herein as commonly used in the field, to mean a relatively large enclosure or chamber to which are connected a plurality of small ducts or conduits.

SUMMARY OF THE INVENTION

Accordingly, it is an important object of the present invention to provide an environmental control system and method for commercial and industrial buildings which overcomes the above mentioned difficulties, effects considerable savings in initial capital expenditure by utilizing hollow horizontal walls or floors as plenums or chambers at close to atmospheric pressure to eliminate expensive ducting; which affords to small groups or single persons individually selected and controlled conditions of air, direction and rate of flow to greatly enhance worker satisfaction and resultant productivity.

The present invention further contemplates substantial savings in costs of changing work spaces as air ducts are eliminated, together with the need for any rearrangement, extension, connection etc. Moreover, the provision of conventional utilities, such as electricity, and change of such utilities is greatly simplified, and the cost reduced. The addition of more recently employed utilities, such as fiber optics, computer cables, and the like, may be included in both new and existing building structures at substantial savings in costs.

Other objects of the present invention will become apparent upon reading the following specification and referring to the accompanying drawings, which form a material part of this disclosure.

The invention accordingly consists in the features of construction, combinations of elements, and arrangement of parts, which will be exemplified in the construction hereinafter described, and of which the scope will be indicated by the appended claims.

DESCRIPTION OF THE PREFERRED EMBODIMENTS

Figure 2:
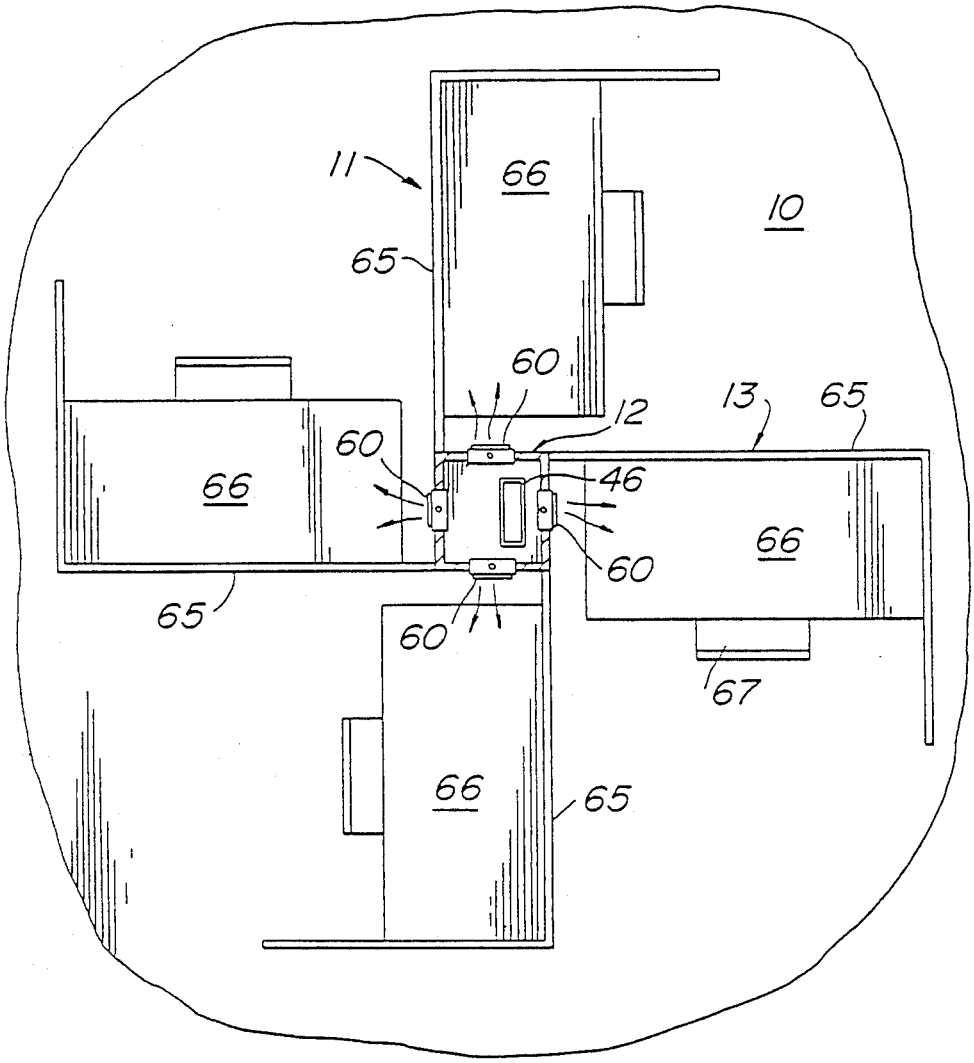
FIG. 2 is a horizontal sectional view taken generally along the line 2—2 of FIG. 1.

Referring now more particularly to the drawings, and specifically to FIG. 2 thereof, a building floor is there generally designated 10, on which is installed a work station 11 including a central upright air column or passageway 12, and a plurality of individual work places, counters or desks 13 extending radially outwardly from the central column or passageway 12.

Figure 1:
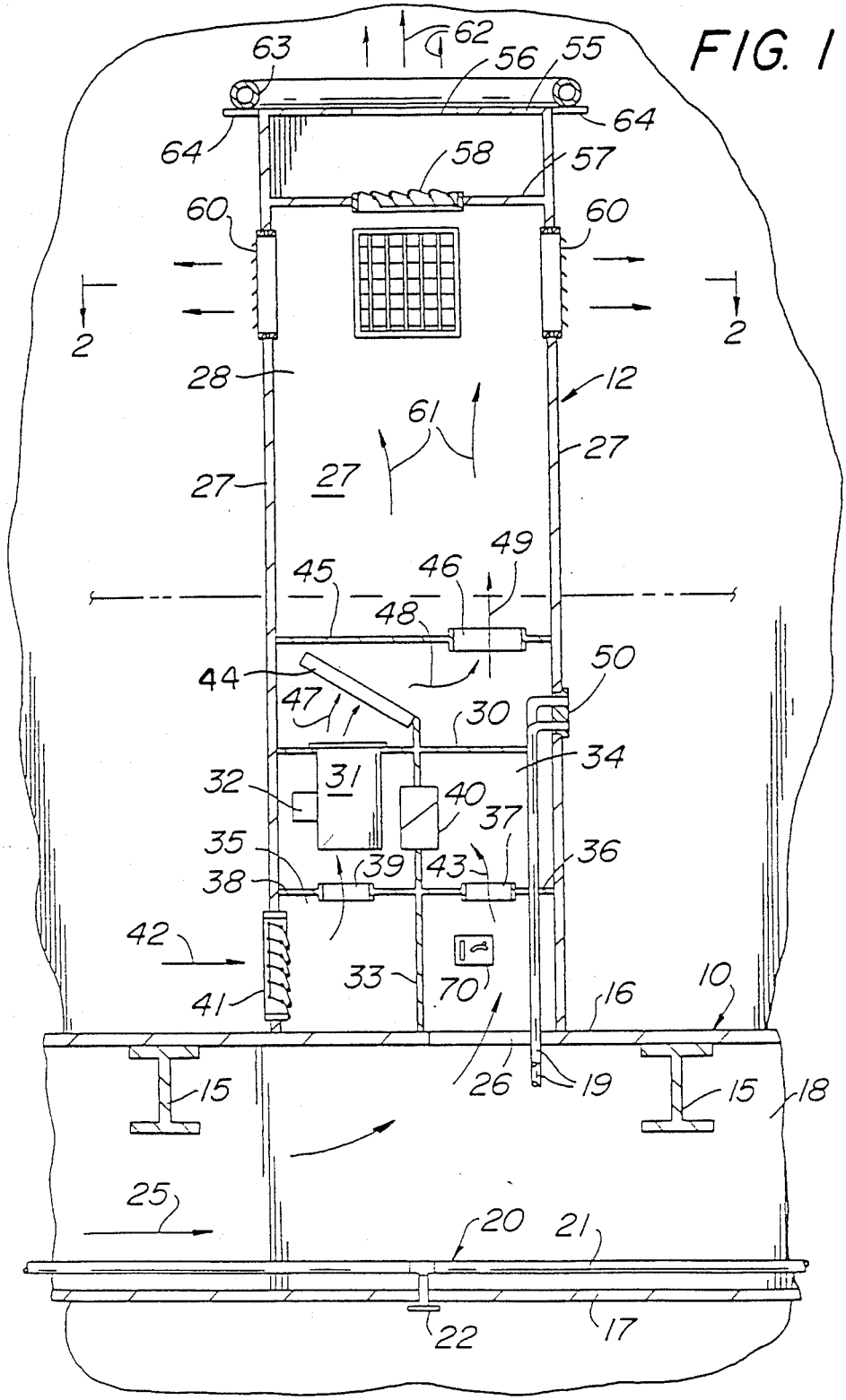
FIG. 1 is a sectional elevational view showing a personalized environmental control station in accordance with the teachings of the present invention.

The column or passageway 12 is best seen in FIG. 1 and may extend transversely of or upstand from the floor 10. The floor 10 may include support structure, such as beams 15 which carry an upper horizontal surface or raised floor 16. A lower horizontal surface or floor 17 is located in sapced relation from the raised floor 16 and combines with the latter to define a generally horizontally extending interior hollow or space 18.

As will appear more fully hereinafter, the substantial space of interior hollow 18 need not be obstructed by air ducts, or the like, and may provide an efficient plenum for or reservoir of conditioned air. If desired, return air ducts and various utilities may be supplied through the hollow 18 of horizontal wall 10, such as electric power, electronic and optical communications, water, and other. Utility conduits, as desired, are shown typically at 19. A sprinkler system 20 may include piping 21 in the hollow 18 and sprinkler heads 22 extending from the piping through the floor 17. The plenum chamber or hollow space 18 is substantially unobstructed in all horizontal directions, notwithstanding the presence of beams 15, utilities 19, 20 and 21, and the like. In practice, the chamber or hollow 18 is generally coextensive in all horizontal directions with the floor 10 and room space above the floor.

A supply of conditioned air communicates with the plenum or chamber 18, flowing as indicated by arrows 25. The conditioned air 25 is advantageously at substantially atmospheric pressure in the plenum 18 to minimize air moving energy requirements and substantially avoid leakage to and from the plenum without expensive sealing of the plenum. More specifically, the preconditioned air may be pressurized above atmosphere only enough to fill air into the plenum, but not further, since energy to move the air out of the plenum is supplied by a separate fan when needed, as will appear hereinafter.

The upper layer or raised floor 16 of floor 10 is provided with one or more through openings as at 26, which openings may be provided with closures for nonuse.

Over a selected floor opening 26 is located the upstanding passageway or column 12, which may be of generally polygonal cross section, say constituted of a plurality of generally upright side walls 27 combining to define therebetween the interior hollow 28 of the column or passageway 12.

In the illustrated embodiment there are four upstanding side walls 27, but the number may vary if desired, and the column or passageway 12 need not be of polygonal horizontal cross section, but may be constituted of a cylinder of circular cross section, or other suitable configuration, as desired.

Interiorly of the column or passageway 12, adjacent to and spaced from the horizontal wall or floor 10, there may be provided a horizontal partition 30 extending transversely across the interior hollow 27 of the column. Mounted by the partition or interior column wall 30 may be an air mover or fan 31 driven by suitable motive means 32, such as a motor, to displace air from the lower side of wall or partition 30 adjacent to floor 10 to the upper side of the wall or partition 30. In addition, a partition or wall 33 may extend longitudinally within the interior hollow 28 of the column 12, generally vertically between the partition 30 and the raised floor 16. The upright partition or bulkhead 33 subdivides the space between horizontal partition 30 and raised floor 16 into a pair of compartments 34 and 35. The compartment 34 communicates through the floor opening 26 with the plenum 18, while the compartment 35 communicates through the air mover 31 with the interior hollow 28 above the partition 30.

The compartment 34 may be subdivided by a vertically intermediate, generally horizontal partition 36 having a through opening 37; and similarly the compartment 35 may be vertically subdivided by a generally horizontal partition 38 having a through opening 39.

Located in the upright partition or bulkhead 33, for communication between the compartments 34 and 35, is an air proportioning device or valve 40 for passing conditioned air from the compartment 34 to the air mover 31 at a desired rate. Communicating between the interior of compartment 35 and the immediate environs, being the room space, is a one way air valve or relief damper 41. By the backdraft or relief damper 41, room air may pass in the direction of arrow 42 into compartment 35 for mixture with conditioned air passing in the direction of arrow 43 and through air proportioning valve 40. This mixture of air may be passed by the fan or blower 31 through and upwardly beyond the partition 30. Valve 40 is controlled by a sensor in chamber 34, which tends to close valve 40 as the air temperature at 43 drops. When valve 40 reaches its fully closed position, only induced air from 42 will enter the air mover through relief damper 41.

Spaced over the generally horizontal partition 30 is an additional generally horizontal partition 45 having a through opening or aperture 46 spaced laterally from the air mover 31. An air heater or heat exchanger 44 may be interposed between the partitions 30 and 45, and between the fan 31 and aperture 46 for heating or treating air passing therebetween. That is, air passing in the direction of arrows 47 from air mover 31 passes through heat exchanger 44 and hence in the direction of arrows 48 and 49 into the upper interior hollow 28 of the column or passageway 12. The air proportioning device 40 is controlled to mix room air 42 and conditioned air 43 in desired proportions; air mover 31 being suitably controlled, as through speed controlled motor 32, to move the air mixture at a desired rate; and heat exchanger 44 being suitably controlled to impart a desired heating influence on the air being moved.

The utilities 19 may extend upwardly through partition 30 and be provided with suitable connector means 50 in a side wall 27 for convenient access from exteriorly of the column.

The upper end of column or passageway 12 remote from the floor 10 may be provided with an end wall 55, preferably having a through opening 56. Adjacent to and spaced below the upper column end wall 55, interiorly of the column hollow 28, there may be provided a generally horizontal internal wall or partition 57 having mounted therein a relief damper or diffuser 58. That is, the horizontal partition or wall 57 is spaced over the horizontal wall or partition 45, for passage of excess air 49 from the hollow 28 of column 12 through relief damper or diffuser 58, upon sufficient pressure difference on opposite sides of the relief damper or diffuser when outlets 60 approach their fully closed position.

A plurality of air outlets or vents 60 are provided in the walls 27 of column or passageway 12, spaced between the partitions 45 and 57. The air outlets or vents 60 are advantageously adjustable both volumetrically and directionally, such as used for ventilating passenger vehicles. In practice, each wall 27 of the column 12 may be provided with an adjustable vent 60. When excess air is fed into the hollow 28 between partition 45 and 57, as at 61, for exit through the vents 60, the excess may pass upwardly and outwardly through the relief damper 58 and opening 56, as at 62. At the upper end or top wall 55 of column 12 there may be mounted an illumination means or lamp 63, say an annular lamp seated on arms 64 outstanding from the column, for dispensing light upwardly and downwardly to the surrounding workplaces. Cool air moving over the lamps reduces their operating temperature. This helps the lamps work more efficiently and lengthens their useful life.

As shown in FIG. 2, each work place may include a generally upright separator or wall 65 extending generally radially outwardly from the column or passageway 12. More specifically, each separator or wall 65 extends generally radially outwardly from the passageway or column 12 at a location thereon spaced between an adjacent pair of air outlets 60. A work bench or desk 66 may be located at suitable working height close to each separator 65, and may be provided with its respective seat or stool 67. Thus, as best seen in FIG. 2, the space between each adjacent pair of generally radially extending separators 65 define an individual work space, and each air outlet or vent 60 is associated with a respective work space for dispensing conditioned air at the desired rate and in the desired direction, as selectively and personally controlled by the occupant of the work space.

A thermostatic sensor is shown at 70, which may be located in the supply air stream 43, and may thermostatically control operation of the air proportioner 40, air mover 31 and heater or heat exchanger 44. These components may be individually controlled; or preferably the control of these components may be automatic and located remotely from the work station, for example at a central microprocessor, to allow the individuals to provide their own desired quantity and direction of conditioned air through their respective air outlets 60, Obviously, the overall room temperature, say in hot weather conditions, need not be so cool as the air mixture supplied directly to the work places, to effect substantial savings in cooling load. Cold weather operation may effect similar savings in the total heating load. Further, the air movement load is minimal as primary air movement is just sufficient to fill the plenum 18; and from the plenum, air is only moved as and when needed by the individual movers 31.

Figure 3:
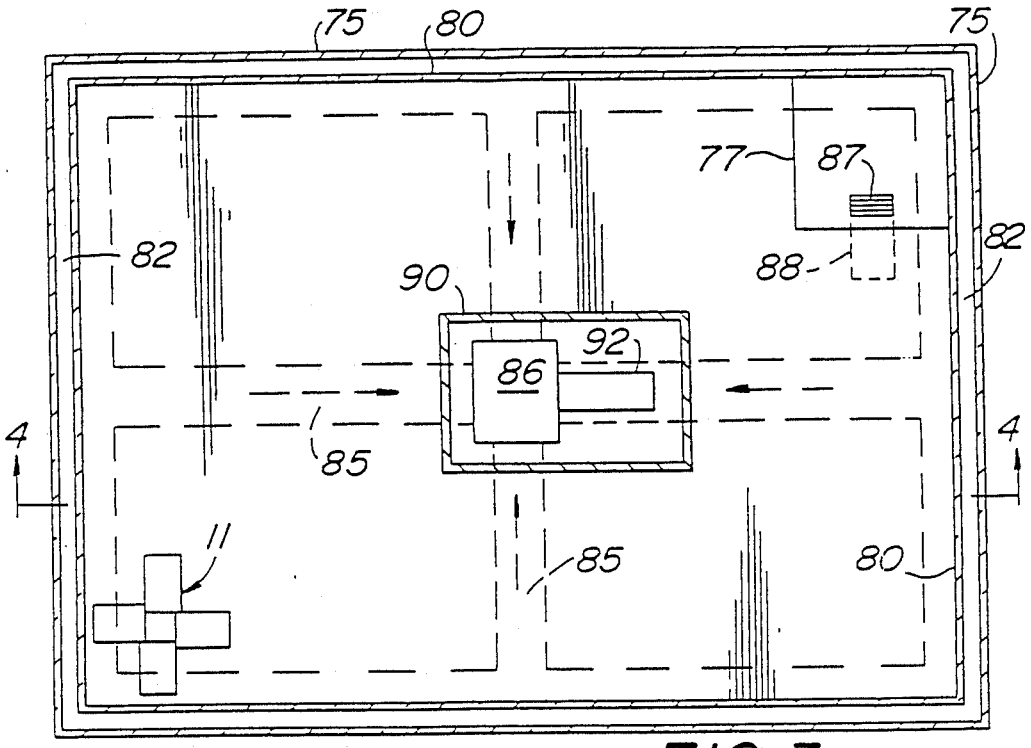
FIG. 3 is a plan view showing a typical building floor employing the personalized air conditioning of the present invention.
Figure 4:
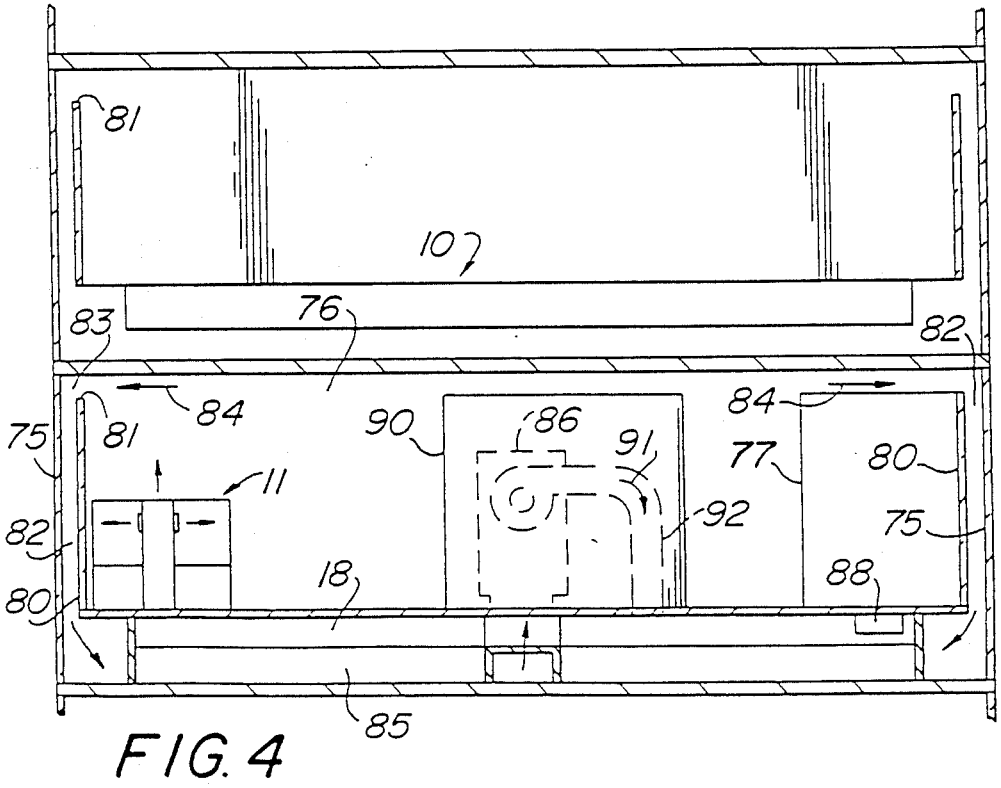
FIG. 4 is a sectional elevational view taken generally along the line 4—4 of FIG. 3.

Referring now to FIGS. 3 and 4, the plan view of FIG. 3 illustrates a horizontal partition or floor 10 and circumferential upright outer walls 75 bounding the room space 76. A single work station 11 is shown in one corner of the room space 76, but any desired number of work stations may be selected and located as desired. A private office 77 is shown in another corner of the space 76, but may be located elsewhere, as desired.

Extending along and spaced inwardly from the outer walls 75 are inner walls 80, which upstand from the horizontal wall 10 to an upper bounding edge 81, adjacent to and spaced below the next adjacent upper floor 10. This is best seen in FIG. 4. Thus, the inner walls 80 combine with the outer walls 75 to define an interwall space substantially surrounding the room space 76, and interposed between the room space and the exterior of the outer wall 75. Such interwall space may be designated 82. The spacing of the upper edge 81 of inner wall 80 below the next upper horizontal partition 10, as at 83, defines an upper fluid communication means for passing return air or removing room air, as in the direction of arrow 84, to the interwall space 82.

The lower region of the interwall space 82 may be open to one or more return air ducts, as at 85. The ducts 85 may pass through the plenum 18 and not directly communicate with the plenum, but communicate with an air conditioning unit 86, which in turn communicates and passes conditioned air to the plenum. The return air ducts 85 in the plenum 18 thus define a lower fluid communication means for removing air from the interwall space 82 for treatment and return to the plenum 18. Thus, return air passes downward through the interwall space 82 to define an insulating air curtain interposed between the room space 76 and the building exterior. By this air curtain heat gains or losses between the room space and building exterior are minimized for improved cooling capacity and energy efficiency. Further, the interwall space 82 may be utilized for blinds, or other accessories, and advantageously the inner walls 80 are transparent for light permeability and moveably mounted, as on tracks, for convenient access to the interwall space. The lower fluid communication means or return air ducts 85 may be provided with suitable dampers or other flow control means communicating with the air supply plenum 18 to enable adjusting the return air temperature, if desired and to lighten the load on the central unit 86.

In the illustrated embodiment there is provided a central core 90 in the room space 76, including the air unit 86 for passing conditioned air, as at 91, through conduit 92 to the plenum. The central core 90 may house various utilities also, if desired. However, the air unit 86 need not be located in the room space 76, but may be located elsewhere, as desired.

The office 77 may be private with walls 78 and 79 from floor to ceiling, or otherwise as desired. A floor supply outlet 87 may be located in the office 77 and communicate with the plenum 18, as by a fan-air terminal 88 in the same way as column or passageway 12.

Figure 5:
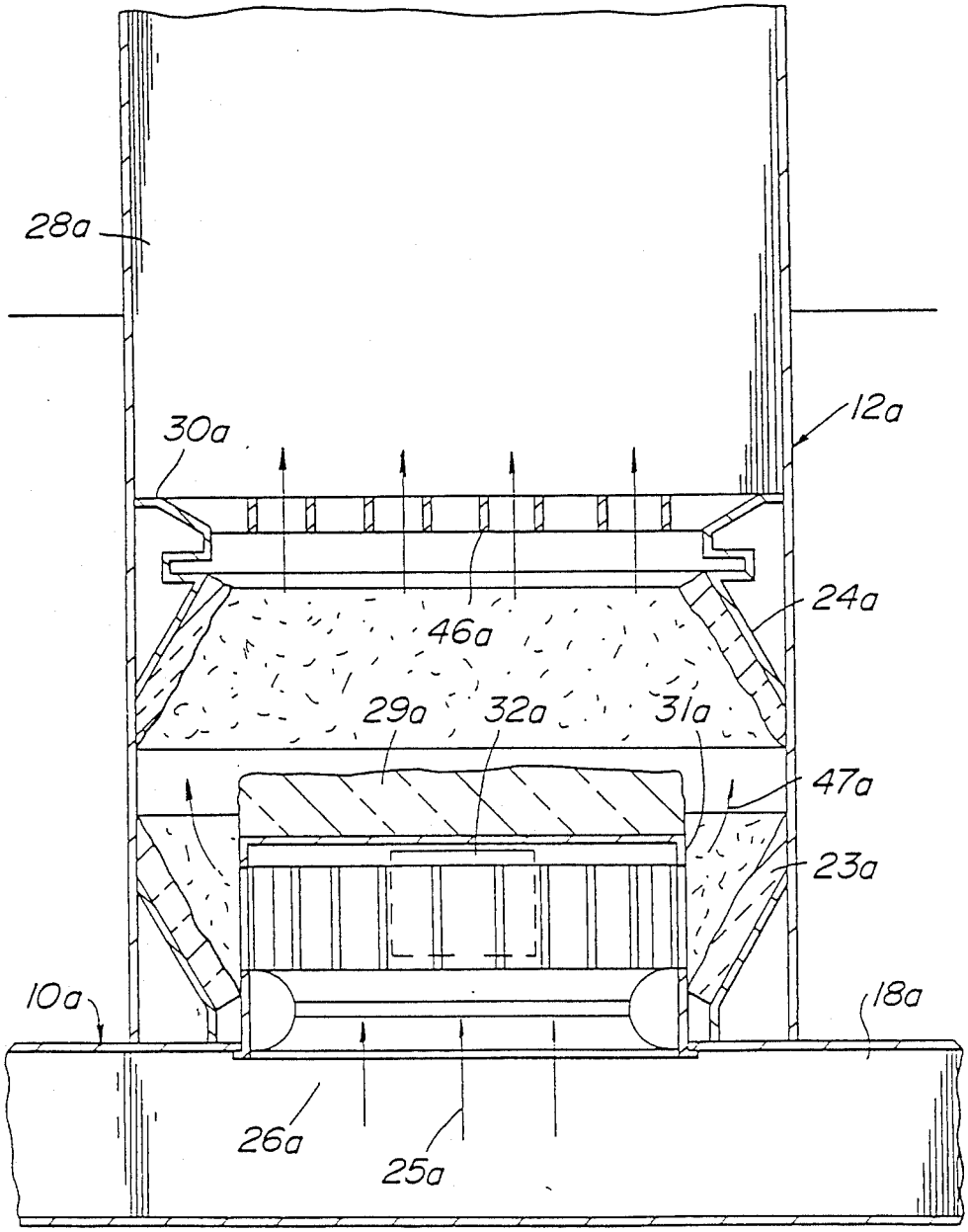
FIG. 5 is a sectional elevational view showing a modified embodiment of the lower region of the station of FIG. 1.

A slightly modified embodiment is shown in FIG. 5, wherein a passageway or column 12*a* on a floor 10*a* has its hollow interior 28*a* communicating downwardly through a floor opening 26*a* with a floor hollow or plenum 18*a*.

An air mover, fan or blower 31*a* is mounted over the floor opening 26*a*, and may be driven by suitable motive means, such as a motor 32*a*. The air mover or blower 31*a* may be axial, centrifugal, or mixed flow type, having an inlet for receiving plenum air, as at 25*a*; and the air may emerge peripherally or axially, or both, from the air mover or fan 31*a*, as at 47*a*.

Surrounding the air mover or blower 31*a* may be upwardly diverging walls 23*a* for directing the fan exiting air 47*a* generally upwardly; and, upwardly converging or tapering walls 24*a* may be provided interiorly of the column 12*a* directing air to the horizontal wall opening 46*a*. The walls 23*a* and 24*a* may advantageously be fabricated of sound insulating material; and, a layer of sound insulating material 29*a* may be provided on top of the air mover 31*a*, all for minimizing noise.

Figure 6:
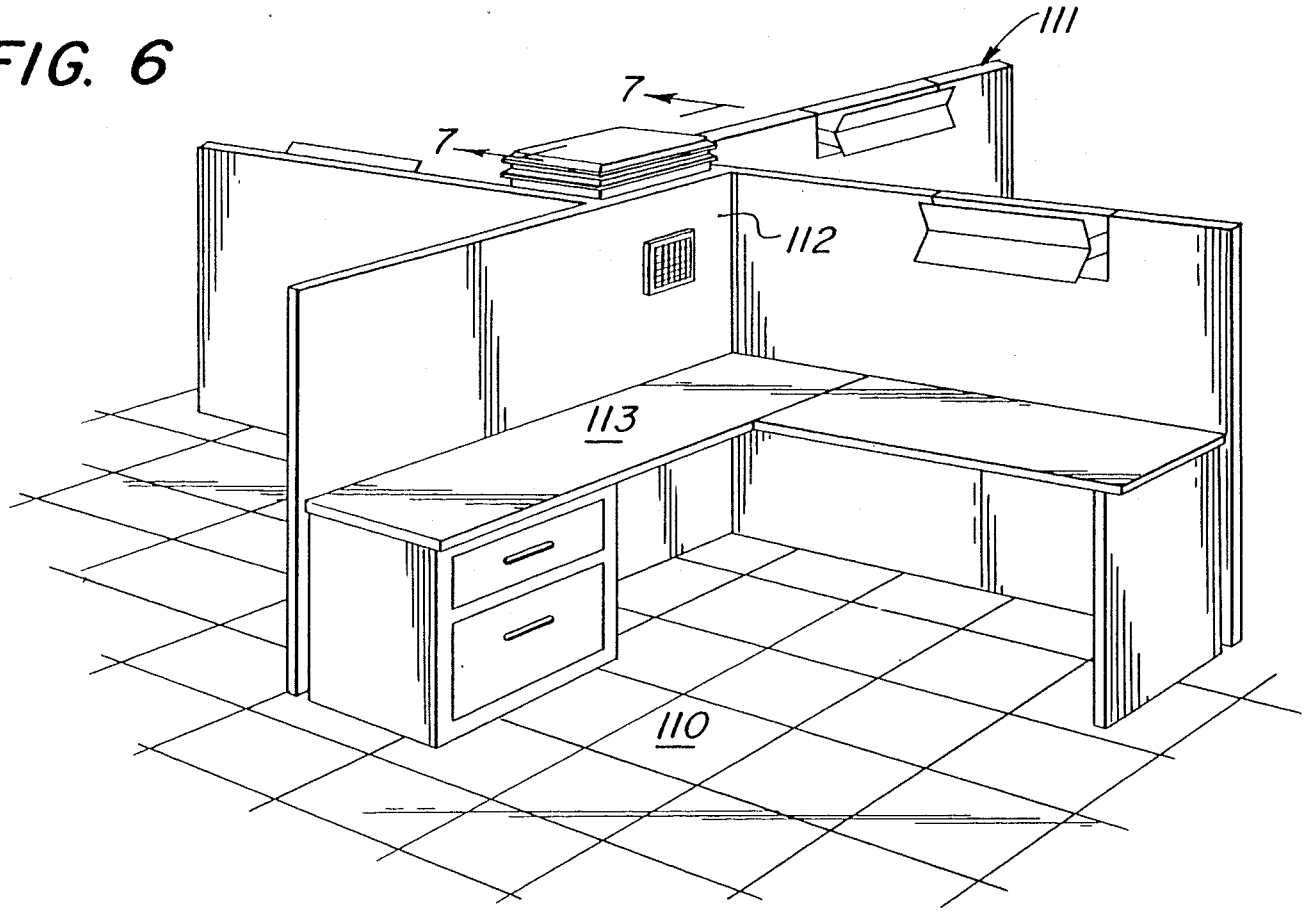
FIG. 6 is a top perspective view showing a slightly modified embodiment of the personalized environmental control work station in accordance with the teachings of the present invention.

Referring now to FIG. 6, a building floor is there generally designated 110, on which is installed a work station 111 including a central upright air column or passageway 112, and a plurality of individual work spaces, counters or desks 113 extending radially outwardly from the central column or passageway 112.

Figure 7:
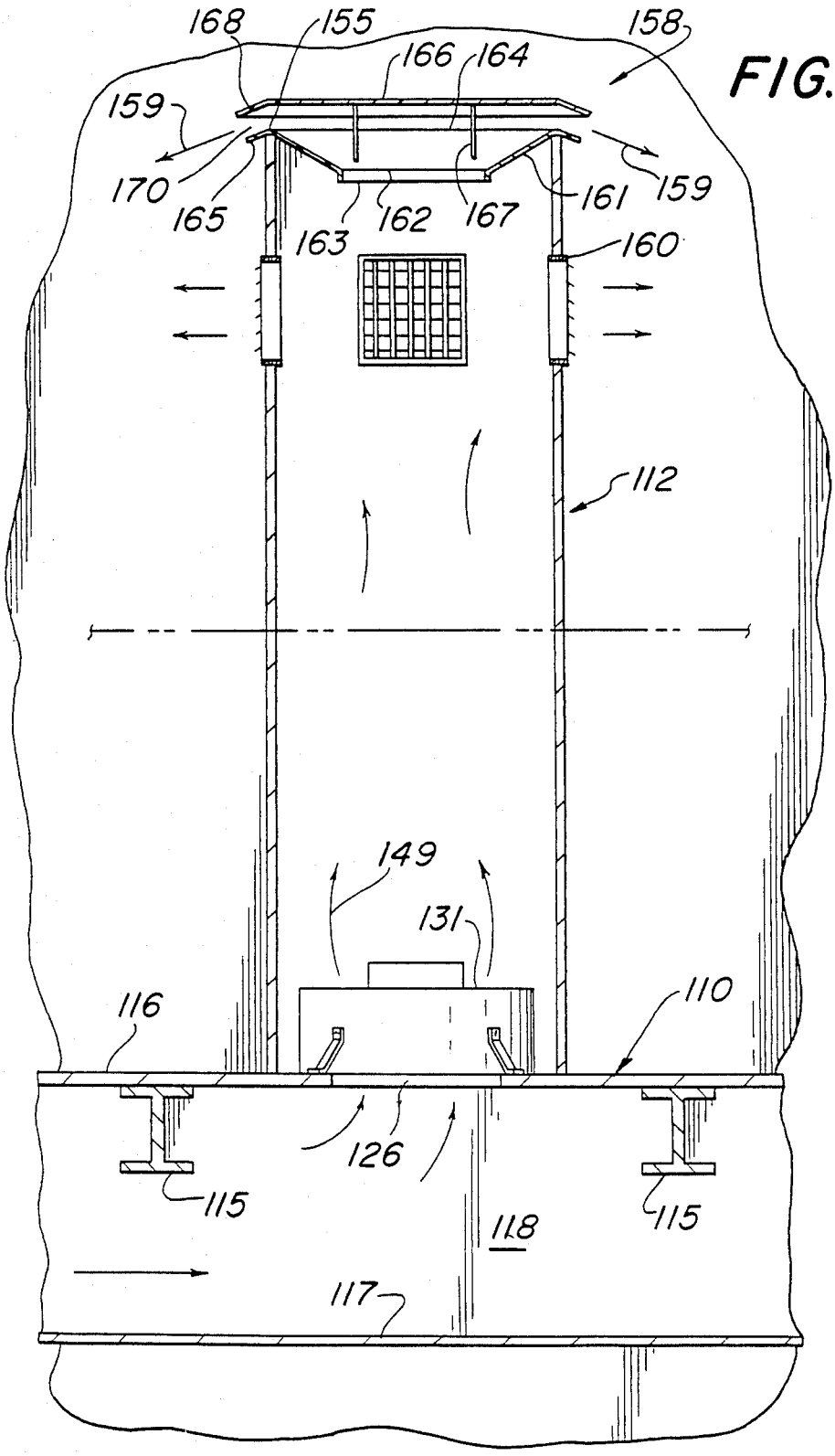
FIG. 7 is a partial sectional elevational view, enlarged, taken generally along the lines 7—7 of FIG. 6.

The column or passageway 112 is best seen in FIG. 7 and may extend transversely of or upstand from the floor 110. The floor 110 may include a support structure, such as beams 115 which carry an upper horizontal surface or raised floor 116. A lower horizontal surface or floor 117 is spaced below the raised floor 116 and combines with the latter to define a generally horizontally extending interior hollow, space or plenum chamber 118. It will be observed that the support structure 115 is spaced over the lower floor 117 so that the enclosed space or plenum chamber 118 is generally unobstructed horizontally and substantially coextensive horizontally with the floor 110 and the room space above the floor. Further, the plenum chamber 118 is capable of containing utility conduits, also without appreciable obstruction to horizontal movement of air in the chamber.

A central supply of conditioned air communicates with the plenum or chamber 118, being at substantially atmospheric pressure, and just sufficiently above to fill air into the plenum without causing appreciable leakage from the plenum. Thus, the plenum need not be more effectively sealed than is conventional. This minimum need for pressure in the plenum minimizes the air moving energy requirements of conditioned air into the plenum and minimizes the leakage of conditioned air from the plenum while precluding the leakage of atmospheric air into the plenum. As previously described, conditioned air removal from the plenum to the room space is effected only when and where needed by a separate air mover or fan in each column 112.

The column 112 upstands from the upper floor surface 116 over a selectively located floor opening 126. An air mover or fan 131 is located in the column 112 in a lower region thereof for drawing conditioned air from the plenum 118 upwardly into the column 112, as indicated by the arrows 149. The fan or air mover 131 may be thermostatically controlled as described hereinbefore in connection with air mover or fan 31.

The upstanding column or passageway 112 may be provided in an upper region thereof, spaced below the upper column end 155, with a plurality of circumferentially spaced air outlets, openings or grills 160. The grills 160 are preferably selectively controllable for volume and direction of air passing outwardly therefrom to the respective desk regions.

As in the illustrated embodiment, the column 112 may be four sided or rectangular, as for use with four desk areas, and employ four grills 160. Of course, the column configuration, and number of desk regions and grills may vary, as desired.

Extending across the upper end of the column 112 is an air distributor 158 which smoothly and in a manner approaching laminar flow circumferentially distributes air, in the direction of arrows 159, to the surrounding room space at a location spaced below the room ceiling. Thus, the conditioned air or mixture thereof distributed as at 159 mixes into the room space at an elevation which is occupied rather than being wasted at an upper, unoccupied elevation of the room space.

The distributor 158 is an air outlet, in addition to the air outlets 160, but is general to the entire work station 111, rather than local to a specific desk region. The distributor is comprised of a generally frusto-conical conduit having its smaller end downwardly, within the column 112 and open, as at 162 being bounded by a generally cylindrical flange 163. The lower, inlet end 162 of the conical distributor conduit 161 is located centrally within the column 112 spaced below the upper column end 155, and spaced above the level of the air outlets or grills 160. The conical conduit 161 enlarges or flares upwardly to an upper, outlet end 164, which opens upwardly and rests on the upper end 155 of the column 112. A circumferential lip 165 extends entirely about and radially outwardly from the upper end 164 of the distributor conduit 161, and projects laterally outwardly beyond the column 112, there declining obliquely with respect to the column.

An upper, top member, plate or deflector 166 extends generally horizontally in spaced relation over the upper end 164 of the distributor conduit 161, being suitably supported on the latter as by upright studs or fasteners 167. The generally horizontal plate or deflector 166 is substantially congruent to and coextensive with the upper open end 164 of the upwardly flaring conduit 161, and is provided with a circumferentially extending lip or flange 168 which overlies the nether lip or flange 165 and also declines obliquely outwardly as the latter.

Thus, the distributor 158 defines a passageway for air entering upwardly through lower opening 162, then turning horizontally and exiting circumferentially between the lower and upper lips 165 and 168, as in the direction of arrows 159. Thus, the circumferential space 170 between the lips 165 and 168 provides an air outlet local to the work station 111 and common to the several desk regions 113, for smoothly distributing air with a minimum of turbulence or disturbance. That is, in contrast to the prior art wherein it is desired to pass conditioned air turbulently into room space to achieve immediate mixture with the room air, by the use of the invention it is advantageous for many reasons to introduce air in a smooth, substantially laminar condition with a minimum of turbulence. This effects considerable savings in air handling energy, comfort to occupants in the immediate area of the air outlet and is enabled by premixture of the conditioned air with return air from the room, as in the column 12 of FIG. 1. While premixing of conditioned and returned room air is not shown in FIG. 7, this may be achieved in the same manner as in FIG. 1, or may be performed in the plenum 118.

In the distributor 158, as the cross section of air movement through the distributor decreases in height along the frusto-conical conduit 161, the cross section increases in circumference, so that air velocity may remain relatively constant to achieve the smooth laminar type glow.

From the foregoing it is seen that the present invention provides a personalized air conditioning system which is extremely simple in construction to effect substantial savings in initial and continuing costs, being highly versatile for use with changing work place requirements, enhancing the comfort of individuals having differing comfort requirements, for increased work place efficiency.

Although the present invention has been described in some detail by way of illustration and example for purposes of clarity of understanding, it is understood that certain changes and modifications may be made within the spirit of the invention.

What is claimed is:

1. In the method of air conditioning a room space, the steps which comprise; providing a horizontally generally unobstructed plenum chamber vertically contiguous to and horizontally generally coextensive with the room space without duct work between the plenum chamber and room space, supplying substantially all necessary conditioned air to the plenum chamber at a pressure above atmospheric just sufficiently to overcome gravity and friction and fill the plenum chamber, selectively locating a vertical passageway in said room space and communicating at one end directly with the adjacent portion of said plenum chamber, the conditioned air being supplied to the plenum at not more than 0.1 inch of water which is insufficient pressure to move a selected rate of conditioned air through said passageway during air conditioning operation, and applying air moving force in said passageway for moving said substantially all necessary conditioned air at a selected rate from said plenum chamber through said passageway to the selected location in said room space for both cooling of a person proximate to the passageway and general cooling throughout the room.

2. The method according to claim 1, further characterized in positioning said passageway generally vertically for discharging conditioned air at an elevation spaced from said plenum chamber and spaced below the ceiling of said room space, to minimize waste of conditioned air above the occupancy level of said room space.

3. The method according to claim 2, further characterized in moving said conditioned air by blowing in said passageway at a location proximate to said plenum chamber.

4. The method according to claim 3, further characterized in communicating between said passageway and a room space at a location between said blowing and plenum chamber, respectively mixing room air with said conditioned air.

* * * * *

US004860642B1

REEXAMINATION CERTIFICATE (2253rd)

United States Patent [19]

[11] B1 4,860,642

Nussbaum

[45] Certificate Issued Mar. 29, 1994

[54] PERSONALIZED AIR CONDITIONING AND METHOD

[75] Inventor: Otto J. Nussbaum, Newtown, Pa.

[73] Assignee: Argon Associates, L.P., Cherry Hill, Pa.

Reexamination Request:
No. 90/003,155, Aug. 19, 1993

Reexamination Certificate for:

| | |
|---|---|
| Patent No.: | 4,860,642 |
| Issued: | Aug. 29, 1989 |
| Appl. No.: | 291,404 |
| Filed: | Dec. 19, 1988 |

[51] Int. Cl.[5] ..... F24F 7/06; F24F 13/06
[52] U.S. Cl. ..... 454/306; 454/233
[58] Field of Search ..... 454/306, 230, 233

[56] References Cited

U.S. PATENT DOCUMENTS

| | | | |
|---|---|---|---|
| 2,434,847 | 1/1948 | Hagen | 98/38.9 |
| 2,633,070 | 3/1953 | Gillham | 165/54 X |
| 2,877,990 | 3/1959 | Goemann | 165/48.1 |
| 3,927,827 | 12/1975 | Strindehag | 98/40.18 X |
| 4,135,440 | 1/1979 | Schmidt et al. | 98/31 |
| 4,353,411 | 10/1982 | Harter et al. | 98/40.19 X |
| 4,531,454 | 7/1985 | Spoormaker | 98/31.6 |

*Primary Examiner*—William E. Tapolcai, Jr.

[57] ABSTRACT

An air conditioning system in a building space having side walls and a hollow horizontal partition or wall which provides a generally unobstructed chamber or plenum for preconditioned air at or close to atmospheric pressure, a hollow column extending from the horizontal partition at a selected location for receiving conditioned air, air outlets in the column for distributing air to the immediate environs of the column, a fan in the column for moving air from the plenum into the column and through the air outlets, and a selectably variable fan control in the building space.

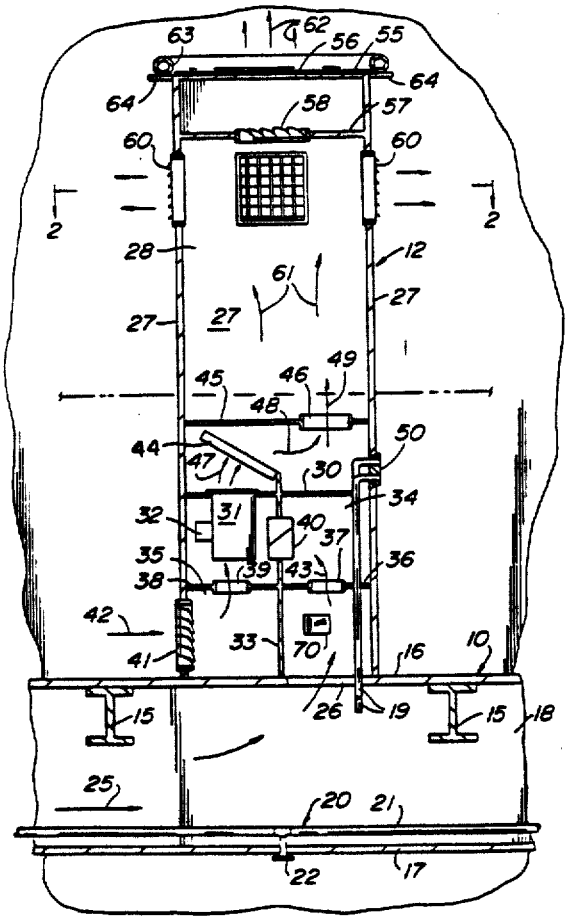

REEXAMINATION CERTIFICATE ISSUED UNDER 35 U.S.C. 307

NO AMENDMENTS HAVE BEEN MADE TO THE PATENT.

AS A RESULT OF REEXAMINATION, IT HAS BEEN DETERMINED THAT:

The patentability of claims 1–4 is confirmed.

* * * * *